US005579912A

United States Patent [19]

Yamamoto

[11] Patent Number: 5,579,912

[45] Date of Patent: Dec. 3, 1996

[54] CONTAINER FOR BEVERAGES

[75] Inventor: Katsuya Yamamoto, Konosu, Japan

[73] Assignee: Sanyo Electric Co., Ltd., Moriguchi, Japan

[21] Appl. No.: 345,922

[22] Filed: Nov. 28, 1994

[30] Foreign Application Priority Data

Nov. 29, 1993 [JP] Japan ..... 5-323197

[51] Int. Cl.[6] ..... B65D 25/00

[52] U.S. Cl. ..... 206/509; 220/634; 220/DIG. 1

[58] Field of Search ..... 206/509, 511; 220/4.12, 4.13, 601, 605, 628, 633, 634, DIG. 1

[56] References Cited

U.S. PATENT DOCUMENTS

| | | | |
|---|---|---|---|
| 3,095,111 | 6/1963 | Mulder | 220/634 X |
| 3,200,998 | 8/1965 | Mahar | 220/633 X |
| 4,032,047 | 6/1977 | Wilson | 220/DIG. 1 X |
| 4,921,126 | 5/1990 | Waltke et al. | 206/509 X |
| 5,469,985 | 11/1995 | Furuichi et al. | 206/509 X |

*Primary Examiner*—Steven M. Pollard
*Attorney, Agent, or Firm*—Darby & Darby, P.C.

[57] ABSTRACT

A container for a beverage has a body, an upper peripheral wall extending upward from the top of the body, a lower peripheral wall extending downward from the bottom of the body, and hose connection ports provided on a top surface of the body surrounded by the upper peripheral wall for having hoses connected thereto. The upper peripheral wall and the lower peripheral wall have respective shapes complementary to each other which enable one of the upper peripheral wall and the lower peripheral wall to be fit in the other of the upper peripheral wall and the lower peripheral wall. At least one of the upper peripheral wall and the lower peripheral wall is formed with at least one cut-out portion for permitting the hoses to be connected to the hose connection ports from the outside, when the container and a container having an identical construction are stacked such that one is fit in or on the other.

19 Claims, 6 Drawing Sheets

CONTAINER FOR BEVERAGES

BACKGROUND OF THE INVENTION

1. Field of the Invention

This invention relates to a container for beverages, such as a syrup tank for use e.g. in a cup vending machine (cup vender) or a beverage dispenser.

2. Prior Art

A syrup tank used in a cup vender for automatically vending beverages, a beverage dispenser for dispensing beverages or the like is a container for holding a syrup (condensed liquid) of a beverage for sale. From a sanitary point of view, such a syrup tank is washed and replenished with a syrup in a factory, and connected to the cup vender or the beverage dispenser in situ. On the other hand, in the cup vender or the beverage dispenser, the syrup held in the syrup tank is supplied to a vending cup by pumping (as disclosed in Japanese Provisional Patent Publication (Kokai) No. 3-12949) or by pressure of gas, such as carbon dioxide (as shown in FIG. 1, and FIG. 2A and FIG. 2B attached hereto). The syrup tank is connected to a feed hose and a gas hose provided in the cup vender or the beverage dispenser, when in use.

More specifically, the syrup tank has not only a container lid but also hose connection ports provided on the top surface thereof. The feed hose and the gas hose are connected to the hose connection ports. On the other hand, as shown in FIG. 1, a syrup tank 61 has an upper protector 62 and a lower protector 63 mounted on respective upper and lower ends thereof. These protectors are provided for prevention of overturn of a body 64 and damage to the hose connection ports 65, 65, which can occur e.g. when the syrup tank is washed and refilled within a factory. Further, when the syrup tanks 61 are stored or transported, they are stacked one upon another. However, separate stacks of syrup tanks directly placed one upon.another are unstable, and therefore, the syrup tanks 61 are conventionally stacked with a pallet interposed therebetween.

Such conventional syrup tanks necessitate pallets when they are stacked, as described above, and hence the work of stacking is troublesome. Further, in setting an increased number of syrup tanks for use in order to increase the number of kinds of beverages for sale, or to improve exchanging efficiency of syrup tanks, an enlarged floor area is required, even if each of the syrup tanks may be small in capacity. Therefore, there is a limit in the number of syrup tanks that can be set for a cup vender or a beverage dispenser for which only a limited space is available. If the syrup tanks are arranged in a stack, this inconvenience can be overcome. However, stack of syrup tanks immediately placed one upon another is very unstable, and further, they should have hoses connected thereto when in use, although such connections are not required when they are stored or transported. Therefore, practically, it is impossible to use syrup tanks in a stack for the cup vender or the beverage dispenser.

SUMMARY OF THE INVENTION

It is the object of the invention to provide a container for beverages which is capable of being stacked stably and immediately upon another container having an identical construction and also being used in a stacked state.

To attain the above obtain the above object, the invention provides a container for a beverage having a body, an upper peripheral wall extending upward from the top of the body, a lower peripheral wall extending downward from the bottom of the body, and hose connection ports provided on a top surface of the body surrounded by the upper peripheral wall for having hoses connected thereto.

The container for a beverage according to the invention is characterized in that the upper peripheral wall and the lower peripheral wall have respective shapes complementary to each other which enable one of the upper peripheral wall and the lower peripheral wall to be fit in the other of the upper peripheral wall and the lower peripheral wall, and that at least one of the upper-peripheral wall and the lower peripheral wall is formed with at least one cut-out portion for permitting the hoses to be connected to the hose connection ports from the outside, when the container and a container having an identical construction are stacked such that one is fit in or on the other.

According to the beverage container of the invention, the upper peripheral wall and the lower peripheral wall have respective shapes complementary to each other which enable one of them to be fit in the other, and therefore, it is possible to stack and set a plurality of containers for beverages of the invention stably and immediately one upon another. Further, since at least one of the upper peripheral wall and the lower peripheral wall is formed with at least one cut-out portion for permitting the hoses to be connected to the hose connection ports from the outside, when the container and a container having an identical construction are stacked such that one is fit in or on the other, it is possible to use containers for beverages of the invention stacked one upon another with the hoses being connected to the containers.

Preferably, the upper peripheral wall and the lower peripheral wall are formed of a resilient material.

According to the preferred embodiment, since the upper peripheral wall and the lower peripheral wall are formed of the resilient material, these upper and lower peripheral walls serve as protectors for the body of the container, thereby preventing damage thereto, in stacking the container or transporting same. Further, a handle for carrying the container or the like can be formed therein with ease.

Preferably, the at least one cut-out portion is formed at least through the upper peripheral wall at a location corresponding to the hose connection ports.

According to this preferred embodiment, the connection of the hoses to the hose connection ports from the outside can be conveniently effected.

Preferably, one of the upper peripheral wall and the lower peripheral wall has an inner peripheral surface formed with a stepped shoulder extending in a circumferential direction, such that an open end of the other of the upper peripheral wall and the lower peripheral wall abuts on the stepped shoulder when the open end is fit in the one of the upper peripheral wall and the lower peripheral wall.

According to this preferred embodiment, it is possible to stack a plurality of containers for beverages according to the invention in a more stable manner.

Further preferably, one of the upper peripheral wall and the lower peripheral wall has an outer periphery of an end thereof formed with a stepped shoulder, such that the stepped shoulder abuts on an open end of the other of the upper peripheral wall and the lower peripheral wall when the one of the upper peripheral wall and the lower peripheral wall is fit in the other of the upper peripheral wall and the lower peripheral wall.

According to this preferred embodiment, it is also possible to stack a plurality of containers for beverages according to the invention in a more stable manner.

Also further preferably, one of the upper peripheral wall and the lower peripheral wall has an inner peripheral surface formed with a stepped shoulder extending in a circumferential direction, such that an open end of the other of the upper peripheral wall and the lower peripheral wall abuts on the stepped shoulder when the open end is fit in the one of the upper peripheral wall and the lower peripheral wall, and at the same time, the other of the upper peripheral wall and the lower peripheral wall has an outer periphery of an end thereof formed with a stepped shoulder, such that the stepped shoulder abuts on an open end of the one of the upper peripheral wall and the lower peripheral wall when the other of the upper peripheral wall and the lower peripheral wall is fit in the one of the upper peripheral wall and the lower peripheral wall.

According to this preferred embodiment, it is possible to stack a plurality of containers for beverages according to the invention in an even more stable manner.

The above and other objects, features, and advantages of the invention will become apparent from the following detail description taken in conjunction with the accompanying drawings.

DETAILED DESCRIPTION

Figure 1:
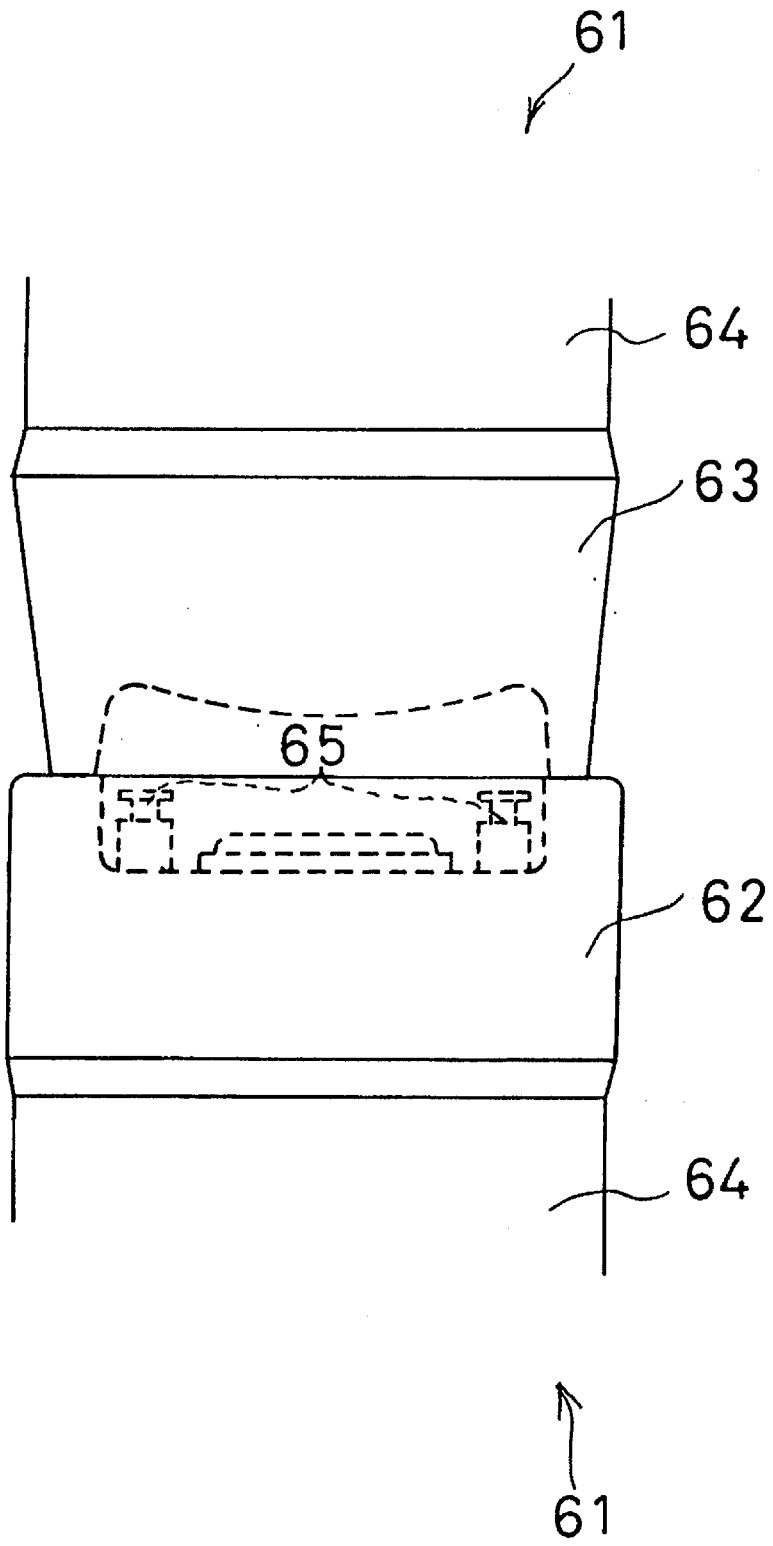
FIG. 1 (PRIOR ART)
FIG. 1 is a side view showing conventional syrup tanks stacked one upon another.
Figure 2A:
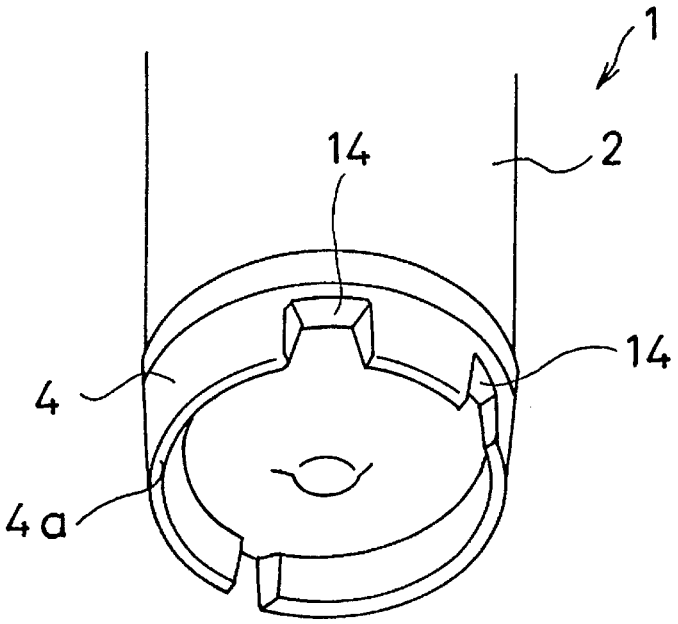
FIG. 2A is a perspective view showing an appearance of a syrup tank according to a first embodiment of the invention, as viewed from the bottom side.
Figure 2B:
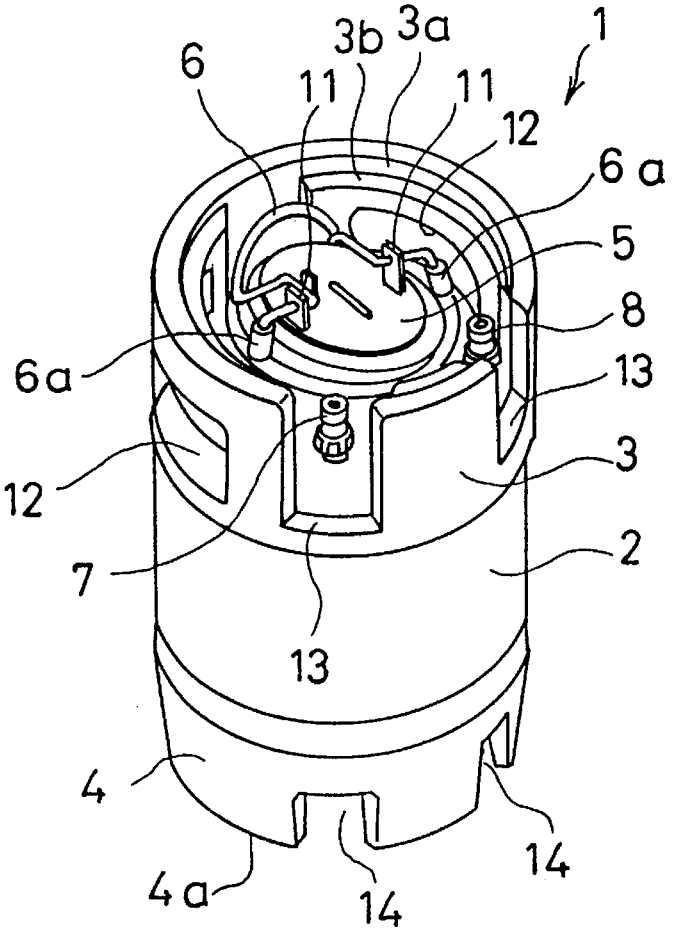
FIG. 2B is a perspective view showing an appearance of the syrup tank shown in FIG. 2A, as viewed from the top side.

A container for beverages according to the invention will be described with reference to drawings showing embodiments thereof applied to a syrup tank. The syrup tank is a stock liquid tank for storing a condensed liquid (stock liquid) of a beverage, such as a cola and a juice. It is connected to a carbon dioxide bomb for feeding the stock liquid held therein to a vend cup of a cup vender (cup vending machine) or a beverage dispenser, by pressure of the gas (carbon dioxide) supplied from the bomb. FIG. 2A shows the syrup tank as viewed from the bottom side, while FIG. 2B shows same as viewed from the top side. As shown in these figures, the syrup tank i is comprised of a body 2, an upper protector 3 formed as an upper peripheral wall extending upward from the top of the body, and a lower protector 4 formed as a lower peripheral wall extending downward from the bottom of the body 2.

Figure 3:
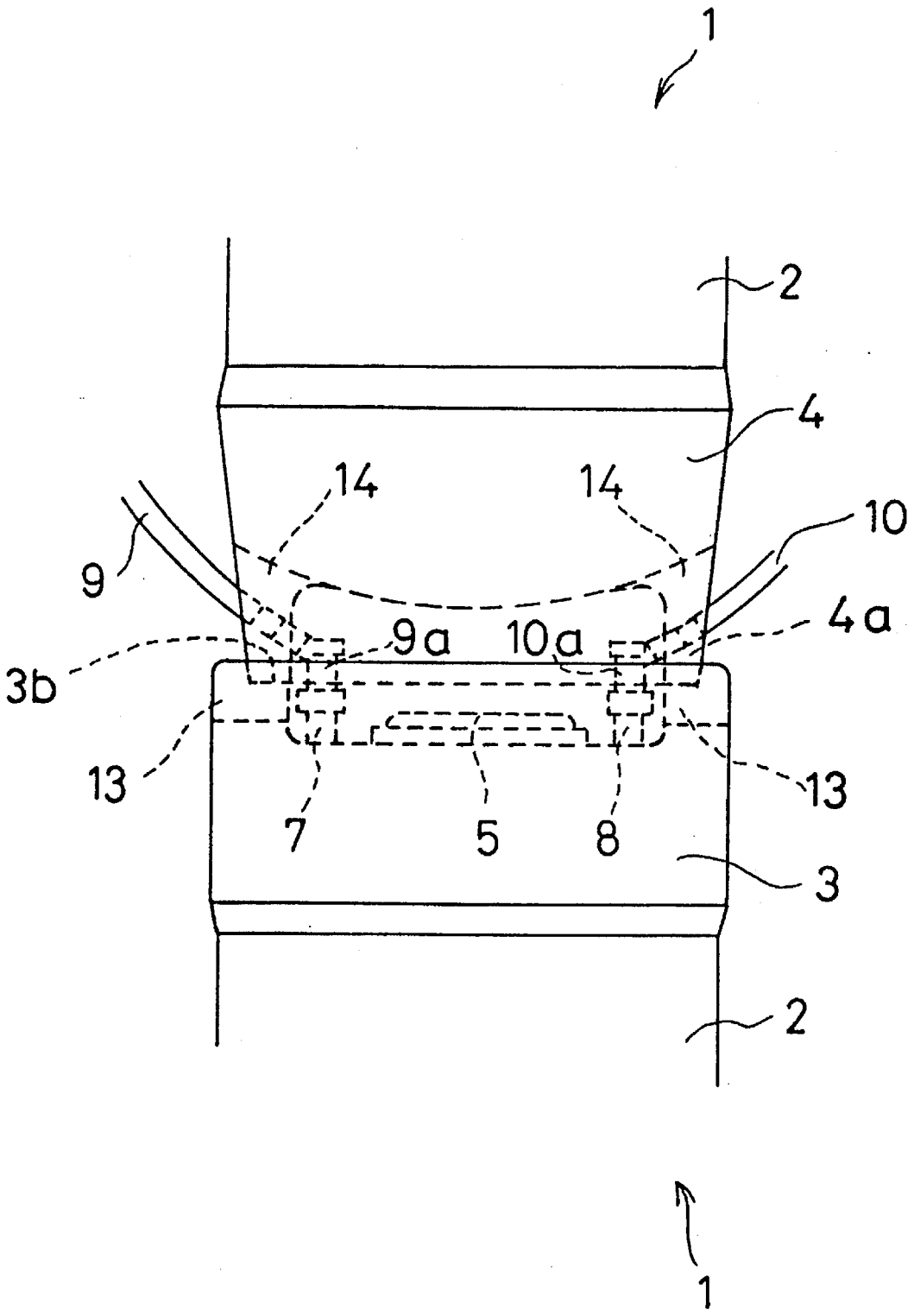
FIG. 3 is a side view showing syrup tanks of the first embodiment in a state stacked one upon another.

The body 2 is formed of a stainless steel or the like, and has a top surface thereof provided with a container lid 5 for opening and closing a wide-mouthed opening formed through the top of the body 2, a handle 6 for opening the container lid 5 and closing same in a fixed manner, an inlet connection port 7 via which the pressure of the gas is introduced into the container from the outside, and an outlet connection port 8 via which the condensed liquid held within the container is supplied to each vend cup. The syrup tank 1 is delivered for service, with the body 2 thereof being filled with condensed liquid, and placed within a cabinet of the cup vender or under a counter on which a beverage dispenser is installed (see FIG. 4 and FIG. 5). A gas hose 9 is connected to the inlet connection port 7, and a feed hose 10 is connected to the outlet connection port 10, as shown in FIG. 3. In this state, the pressure of the gas is applied to the inside of the body 2 via the gas hose 9, to thereby feed the condensed liquid via the feed hose 10 to each vend cup. After service, the syrup tank 1 is collected, and the container lid 5 is opened to wash the inside of the body 2, followed by refilling the container with a condensed liquid of a beverage.

The container lid 5 has an ellipsoidal shape, and is operated by means of the handle 6 for closing the wide-mouthed opening formed through the top of the body from within the body 2. The handle 6 is formed in the shape of a character "106", and rotatably engaged in a pair of hooks 11, 11 projected from the top surface of the container lid 5. When the handle 6 is in a flat position, legs 6*a*, 6*a* of the handle 6 have their open ends abut on a mouth edge of the body 2, pulling the container lid 5 upward by spring tension of the legs 6*a*, 6*a* to close the wide-mouthed opening. When the handle 6 is brought from the flat position to an upright position around the fulcrums of the pair of hooks 11, 11, the open ends of the legs 6*a*, 6*a* are detached from the mouth edge of the body 2 to relieve the container lid 5 from its fixed state, thereby opening the wide-mouthed opening.

The inlet connection port 7 and a connection port 9*a* of the gas hose 9 constitute, as a pair, a snap-in joint, and similarly the outlet connection port 8 and a connection port 10*a* of the feed hose 10 constitute, as a pair, another snap-in joint. Therefore, the gas hose 9 and feed hose 10 can be connected (or removed) to the inlet connection port 7 and the outlet connection port 8, respectively, by simple snap-in operations. In this connection, the connection ports 7, 8 have substantially identical shapes formed of substantially identical materials, and so are the hoses 9, 10.

The upper protector 3 and the lower protector 4 are formed of a resilient material, such as rubber, and firmly adhered to the top and the bottom of the body 2, respectively. The upper and lower protectors 3 and 4 are shaped into respective cylindrical forms having a diameter substantially identical to that of the body 2. The upper protector 3 is provided mainly for carrying the body 2 thereby and for protection of the container lid 5, while the lower protector 4 mainly for stably setting the. container in an upright position. Further, the protectors 3 and 4 serve as cushions when the syrup tanks 1 are stacked one upon another, and make it possible to stack them in a stable manner.

The upper protector 3 is provided such that it surrounds the container lid 5 provided for the top of the body 2 and the connection ports 7, 8 provided thereon, with handles 12 formed through the peripheral wall thereof for carrying the syrup tank 1 thereby. The upper protector 3 is formed at a front portion thereof with a pair of upper cut-out portions 13, 13 at locations corresponding to the inlet connection port 7 and the outlet connection port 8, respectively. Further, as shown in FIG. 3, the upper end of the upper protector 3 has recesses 3*a* (continuous to each other via intermediate recesses in the illustrated example) defined by stepped shoulders 3*b* formed in a circumferential direction around an internal peripheral wall surface thereof, in which the lower end of the lower protector 4, described hereinafter, is fitted. That is, when the lower end of the lower protector 4 is fit in the upper end of the upper protector 3, the end face of the lower end of the lower protector 4 abuts on the stepped shoulders 3*b*.

Similarly, the lower protector 4, which supports the body 2, is formed at a front portion thereof with a pair of lower cut-out portions 14, 14 in a manner corresponding to the upper cut-out portions 13, 13 of the upper protector 3. The upper cut-out portions 13 of the upper protector 3 and the lower cut-out portions 14 of the lower protector 4 form through openings which the inlet connection port 7 and the outlet connection port 8 face when the syrup tanks 1 are stacked one upon another. The gas hose 9 connected to the inlet connection port 7 and the feed hose 10 connected to the outlet connection port 8 can extend therethrough to the outside. Further, the lower end of the lower protector 4 has projections 4*a* formed such that respective peripheral walls thereof are tapered to the bottom for being fit in the recesses 3*a* of the upper protector 3. More specifically, when two syrup tanks 1 are stacked, the projections 4*a* of the lower protector 4 of the upper syrup tank 1 are fit in the recesses 3*a* of the upper protector 3 of the lower syrup tank 1, whereby the syrup tanks 1, 1 are stacked in a stable manner.

Thus, by virtue of the upper cut-out portions 13 and the lower cut-out portions 14 formed in the upper and lower protectors 3, 4 of the syrup tank 1, and the recesses 3*a* and the projections 4*a* formed in same respectively, it is possible to stack syrup tanks 1 immediately one upon another, in a stable manner, and at the same time provide openings for introducing the hoses 9, 10 therethrough, allowing the syrup tanks to be used in a stacked state. Therefore, it is possible to set a plurality of syrup tanks for use in a limited space, as well as to store or carry a stack of syrup tanks placed immediately one upon another.

Figure 4:
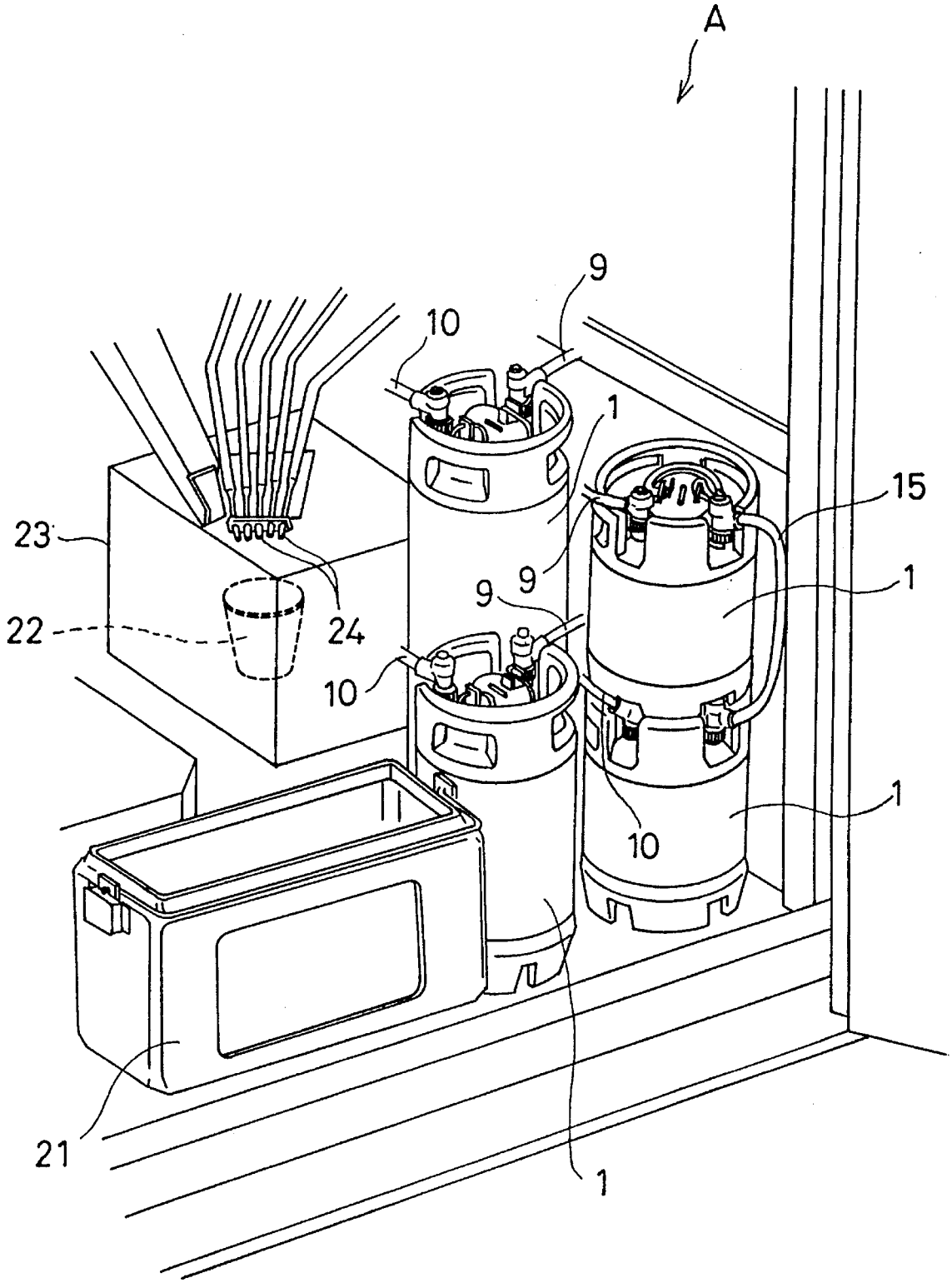
FIG. 4 is a perspective view showing syrup tanks of the first embodiment placed within a cup vender.

FIG. 4 shows an example in which syrup tanks 1 having the above-described construction are set in a cup vender A. As shown in the figure, in the lower space of the cup vender A, there are arranged four syrup tanks1, 1, 1, 1, a waste bucket 21 for drainage, and a cup stage 23 on which a vend cup is set. Each syrup tank 1 has a gas hose 9 connected thereto which is connected to a carbon dioxide gas bomb, not shown in this figure, and a feed hose 10 connected thereto which is connected to one of nozzles 24. However, of the four syrup tanks, two syrup tanks 1, 1 containing condensed liquid of the same kind are stacked one upon another, with the gas hose 9 and the feed hose 10 being connected in series forming a jumper connection through an intermediate hose 15.

Thus, if two syrup tanks 1, 1 are connected in series by jumper connection for supplying one beverage, one syrup tank on a gas hose side can be replaced when it becomes empty. This makes it possible to avoid a case in which a syrup tank has to be replaced before it becomes empty, and a case in which the cup vender continues to be in a sold-out state after the syrup tank becomes empty, thereby increasing exchanging efficiency of syrup tanks 1.

Figure 5:
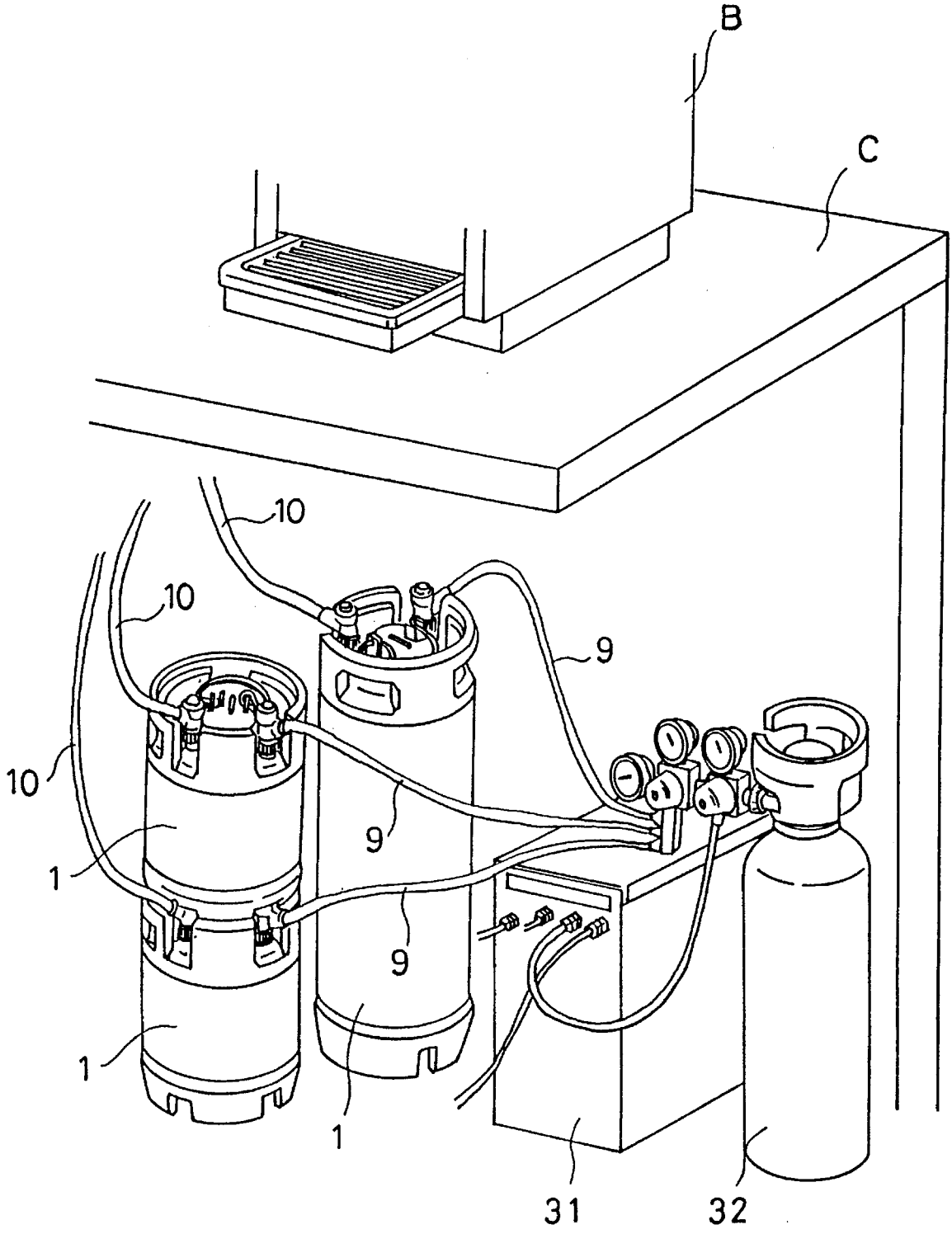
FIG. 5 is a perspective view showing syrup tanks 6f the first embodiment set for a beverage dispenser.

Similarly, FIG. 5 shows syrups tanks 1 set for a beverage dispenser B. As shown in the figure, the beverage dispenser B is placed on a counter C for customers, while the syrup tanks 1 are received in a limited space under the counter C. Under the counter C, there are arranged three syrup tanks 1, 1, 1, a carbonator 31, and a carbon dioxide gas bomb 32, with two of the syrup tanks 1,1 being stacked one upon another. In the present case, the three syrup tanks 1, 1, 1 are filled with condensed liquids of different kinds.

If large-sized syrup tanks 1 and small-sized syrup tanks 1 are selectively used for beverages according to respective expected amounts of sales, and at the same time, the small-sized syrup tanks 1 are arranged in a stack, it is possible to set a large number of syrup tanks 1 in a very small installation area, and hence to increase the number of kinds of beverages without enlarging the installation area.

Figure 6:
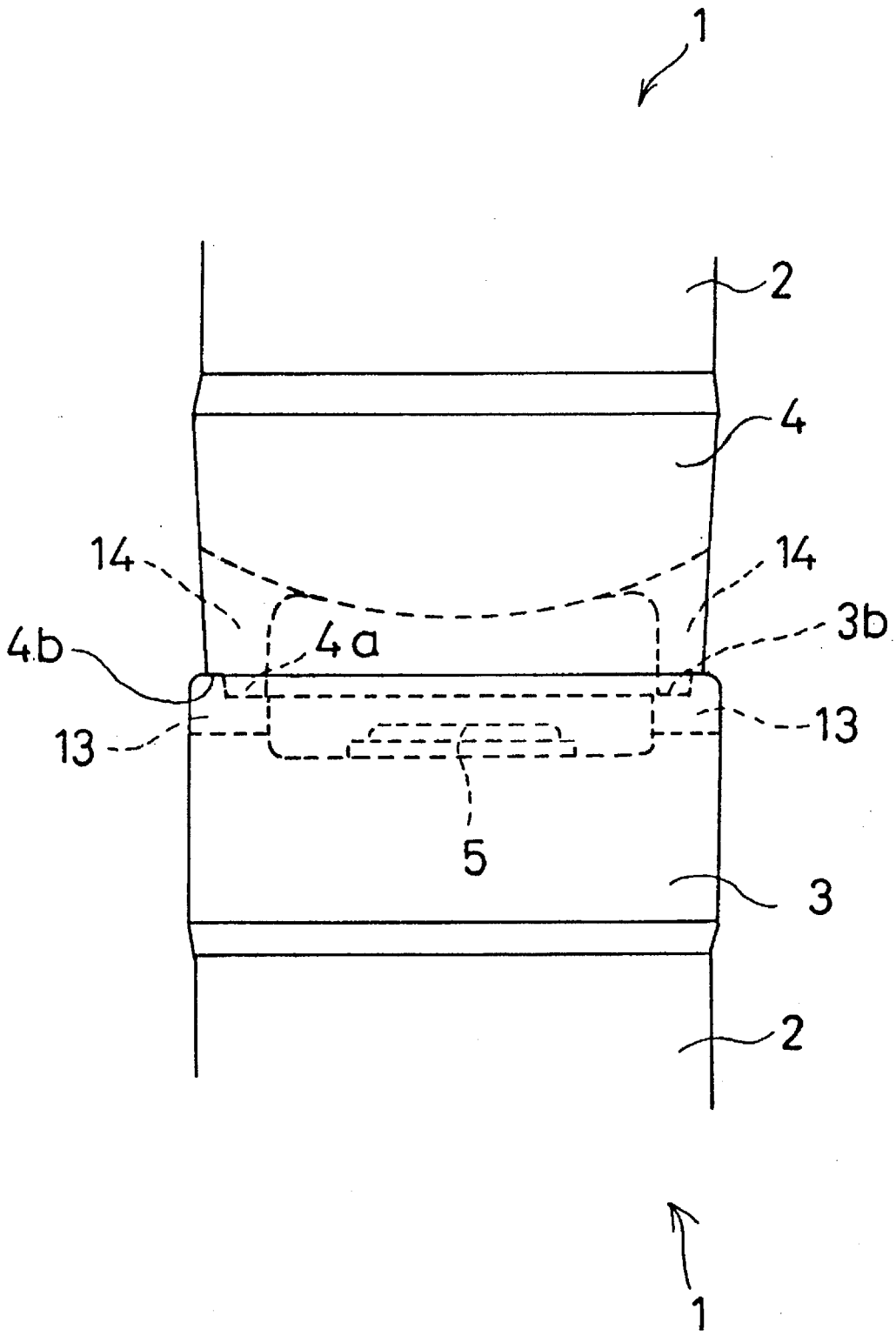
FIG. 6 is a side view showing syrup tanks according to a second embodiment in a stacked state.

FIG. 6 shows syrup tanks 1 according to a second embodiment in their stacked state. As shown in the figure, the upper end of the upper protector 3 is formed with the recesses 3*a* by providing stepped shoulders 3*b* on an internal peripheral surface thereof, similarly to the first embodiment, and the lower end of the lower protector 4 has a stepped shoulder 4*b* formed around the outer periphery thereof and projections 4*a* extending downward therefrom. When the lower end of the lower protector 4 is fit in the upper end of the upper protector 3, the stepped shoulder 4*b* abuts on the end face of the upper end of the upper protector 3 and the projections 4*a* are fit in the recesses 3*a*. This configuration of the lower protector 4 makes it possible to stack syrup tanks 1 in a more stable manner.

Although in the embodiments described above, the upper protector is formed with recesses, and the lower protector with projections, this is not limitative, but the recesses and projections may be provided inversely, i.e. the upper protector may be formed with projections, and the lower protector with recesses. Further, although both the upper protector and the lower protector are each formed with cut-out portions in the above embodiments, this is not limitative, but depending on the level of the stepped shoulders, the height of the connection ports, and the configuration of a joint formed by each pair of connection ports, cut-out portions may be formed only in one of the upper protector and the lower protector.

As described heretofore, according to the container for beverages of the present invention, it is possible to stack containers for beverages immediately one upon another in a stable manner, as well as to use them in a stacked state. Accordingly, it is possible to stack them in a simple and stable manner for storage and transportation, as well as to set a large number of them in a limited installation area.

What is claimed is:

1. In a container for a beverage having a body, an upper peripheral wall extending upward from the top of said body, a lower peripheral wall extending downward from the bottom of said body, and a hose connection port on a top surface of said body surrounded by said upper peripheral wall for having a hose connected thereto, said upper peripheral wall and said lower peripheral wall each having respective shapes complementary to each other to enable one of said upper peripheral wall and said lower peripheral wall of one said container to be fit in the other of said upper peripheral wall and said lower peripheral wall of another said container, said upper periphery wall having a full cut-out portion extending from above the top surface of the container body completely through an upper end thereof for permitting a hose to pass through said upper peripheral wall cut-out portion and be connected to said hose connection port and said lower peripheral wall having a full cut-out portion extending completely through a lower end thereof for permitting a hose to pass through said cut-out portion of said lower peripheral wall and be connected to said hose connection port of the lower container of two said containers of identical construction stacked such that the bottom peripheral wall of one container is fit in or on the top peripheral wall of the other container.

2. A container for a beverage according to claim 1, wherein said upper peripheral wall and said lower peripheral wall are each formed of a resilient material.

3. A container for a beverage according to claim 2, wherein said cut-out portion of said upper peripheral wall is formed at a location opposing said hose connection port.

4. A container for a beverage according to claim 3, wherein the end of one of said upper peripheral wall and said lower peripheral wall has an inner peripheral surface formed with a stepped shoulder extending around its circumference such that an end of the other of said upper peripheral wall and said lower peripheral wall of one container abuts on said stepped shoulder of a peripheral wall of the other container when said end of said other peripheral wall is fit on said end of said one peripheral wall.

5. A container for a beverage according to claim 4, wherein the end of the other of said upper peripheral wall and said lower peripheral wall has an outer periphery formed with a stepped shoulder complementary to the stepped shoulder of one of said upper peripheral wall and said lower peripheral wall such that said complementary stepped shoulder abuts the stepped shoulder at the end of one of said upper peripheral wall and said lower peripheral wall when the other of said upper peripheral wall and said lower peripheral wall of one container is fit in one of said upper peripheral wall and said lower peripheral wall of the other container.

6. A container for a beverage according to claim 3, wherein an end of one of said upper peripheral wall and said lower peripheral wall has an outer periphery thereof formed with a stepped shoulder, such that said stepped shoulder abuts an end of the other of said upper peripheral wall and said lower peripheral wall when one of said upper peripheral wall and said lower peripheral wall of one container is fit in the other of said upper peripheral wall and said lower peripheral wall of another container.

7. A container for a beverage according to claim 2, wherein the end of one of said upper peripheral wall and said lower peripheral wall has an inner peripheral surface formed with a stepped shoulder extending around its circumference such that an end of the other of said upper peripheral wall and said lower peripheral wall of one container abuts on said stepped shoulder of a peripheral wall of the other container when said end of said other peripheral wall is fit on said end of said one peripheral wall.

8. A container for a beverage according to claim 7, wherein the end of the other of said upper peripheral wall and said lower peripheral wall has an outer periphery formed with a stepped shoulder complementary to the stepped shoulder of the one of said upper peripheral wall and said lower peripheral wall such that said complementary stepped shoulder abuts the stepped shoulder at the end of one of said upper peripheral wall and said lower peripheral wall when the other of said upper peripheral wall and said lower peripheral wall of one container is fit in one of said upper peripheral wall and said lower peripheral wall of the other container.

9. A container for a beverage according to claim 2, wherein an end of one of said upper peripheral wall and said lower peripheral wall has an outer periphery thereof formed with a stepped shoulder, such that said stepped shoulder abuts on an end of the other of said upper peripheral wall and said lower peripheral wall when said one of said upper peripheral wall and said lower peripheral wall of one container is fit in the other of said upper peripheral wall and said lower peripheral wall of another container.

10. A container for a beverage according to claim 1, wherein said cut-out portion of said upper peripheral wall is formed at a location opposing said hose connection port.

11. A container for a beverage according to claim 10, wherein the end of one of said upper peripheral wall and said lower peripheral wall has an inner peripheral surface formed with a stepped shoulder extending around its circumference such that an end of the other of said upper peripheral wall and said lower peripheral wall of one container abuts on said stepped shoulder of a peripheral wall of the other container when said end of said other peripheral wall is fit on said end of said one peripheral wall.

12. A container for a beverage according to claim 11, wherein the end of the other of said upper peripheral wall and said lower peripheral wall has an outer periphery formed with a stepped shoulder complementary to the stepped shoulder of the one of said upper peripheral wall and said lower peripheral wall such that said complementary stepped shoulder abuts the stepped shoulder at the end of one of said upper peripheral wall and said lower peripheral wall when the other of said upper peripheral wall and said lower peripheral wall of one container is fit in one of said upper peripheral wall and said lower peripheral wall of the other container.

13. A container for a beverage according to claim 10, wherein an end of one of said upper peripheral wall and said lower peripheral wall has an outer periphery thereof formed with a stepped shoulder, such that said stepped shoulder abuts an end of the other of said upper peripheral wall and said lower peripheral wall when one of said upper peripheral wall and said lower peripheral wall of one container is fit in the other of said upper peripheral wall and said lower peripheral wall of another container.

14. A container for a beverage according to claim 1, wherein the end of one of said upper peripheral wall and said lower peripheral wall has an inner peripheral surface formed with a stepped shoulder extending around its circumference such that an end of the other of said upper peripheral wall and said lower peripheral wall of one container abuts on said stepped shoulder of a peripheral wall of the other container when said end of said other peripheral wall is fit on said end of said one of peripheral wall.

15. A container for a beverage according to claim 14, wherein the end of the other of said upper peripheral wall and said lower peripheral wall has an outer periphery formed with a stepped shoulder complementary to the stepped shoulder of the one of said upper peripheral wall and said lower peripheral wall such that said complementary stepped shoulder abuts the stepped shoulder at the end of one of said upper peripheral wall and said lower peripheral wall when the other of said upper peripheral wall and said lower peripheral wall of one container is fit in one of said upper peripheral wall and said lower peripheral wall of the other container.

16. A container for a beverage according to claim 1, wherein an end of one of said upper peripheral wall and said lower peripheral wall has an outer periphery thereof formed with a stepped shoulder, such that said stepped shoulder abuts on an end of the other of said upper peripheral wall and said lower peripheral wall when said one of said upper peripheral wall and said lower peripheral wall of one container is fit in the other of said upper peripheral wall and said lower peripheral wall of another container.

17. A container for a beverage according to claim 1, wherein said upper cut-out portion of said upper peripheral wall of one container and said lower cut-out portion of said lower peripheral wall are aligned with each other in a vertical direction.

18. A container for a beverage according to claim 1, wherein all closed parts of the lower end of said lower peripheral wall have a peripheral distance sufficient to bridge over the open end of a cut-out of an upper peripheral wall.

19. A container for a beverage as in claim 1, wherein said upper peripheral wall is formed with at least one opening below a closed top end part thereof to form a handle for the container.

* * * * *